US007213607B2

(12) United States Patent
De Almeida

(10) Patent No.: US 7,213,607 B2
(45) Date of Patent: May 8, 2007

(54) MANDREL FOR A GAS LIFT VALVE

(75) Inventor: Alcino Resende De Almeida, Rio de Janeiro (BR)

(73) Assignee: Petroleo Brasileiro S.A. Petrobras, Rio de Janeiro (BR)

( * ) Notice: Subject to any disclaimer, the term of this patent is extended or adjusted under 35 U.S.C. 154(b) by 0 days.

(21) Appl. No.: 10/824,574

(22) Filed: Apr. 14, 2004

(65) Prior Publication Data

US 2005/0061369 A1 Mar. 24, 2005

(30) Foreign Application Priority Data

Apr. 15, 2003 (BR) ..... 0300958

(51) Int. Cl.
*E21B 34/06* (2006.01)

(52) U.S. Cl. ..... 137/155; 166/117.5

(58) Field of Classification Search ..... 137/155; 166/117.5

See application file for complete search history.

(56) References Cited

U.S. PATENT DOCUMENTS 2,963,036 A * 12/1960 Surles ..... 137/155
3,160,113 A * 12/1964 Meyers ..... 137/155
RE25,760 E * 4/1965 Lamb ..... 137/155
4,067,350 A * 1/1978 Raggio ..... 137/155
6,070,608 A * 6/2000 Pringle ..... 137/155
2002/0096332 A1* 7/2002 De Almeida ..... 166/319

* cited by examiner

*Primary Examiner*—Stephen M. Hepperle
(74) *Attorney, Agent, or Firm*—TraskBritt, P.C.

(57) ABSTRACT

The present invention relates to a mandrel for a gas lift valve which comprises an elongated body provided with means of connection at its ends. The body is provided with a side pocket (17) and a side receptacle (16) in the interior of which may be housed a gas lift valve (13) which injects gas into the interior of the body of the mandrel for the gas lift valve (15) by means of orifices (22) positioned in a nose (18). The mandrel for the gas lift valve (15) comprises additionally a lower body (23) provided on the lower part of the valve receptacle (16) of the mandrel of the side pocket (15) in that the lower body (23) is configured in a manner to seal the lower part of the valve receptacle (16) to form a chamber (24) and the lower body is provided with at least one injection orifice to inject gas into the interior of the body of the mandrel of the gas lift valve (15).

16 Claims, 5 Drawing Sheets

MANDREL FOR A GAS LIFT VALVE

BACKGROUND OF THE INVENTION

Field of the Invention

The present invention relates to side pocket mandrels that are normally used to accommodate valves for controlling the flow of injection gas through injection points positioned along the production tubing in a petroleum well, specifically petroleum wells of the type equipped to operate through means of gas lifting.

STATE OF THE ART

Petroleum is normally found in accumulations under pressure in the subsurface in permo-porous rocks known as reservoir rocks, or simply reservoir, or yet producing rocking formations.

Petroleum is a complex mixture of heavy and light hydrocarbons that may range from dry gas (methane) to heavy oil. Depending on the characteristics of the reservoir, some components may be present in larger quantities than other components.

Hydrocarbon fluids, such as petroleum and natural gas, are obtained from these geological formations through means of the boring of wells that penetrates the strata that protects the formation.

In order to drain such natural reservoirs of hydrocarbons (for example, petroleum) a bore is typically drilled in the ground from a position on the ground surface in order to communicate the reservoir with processing installations mounted on the ground surface, adapted to collect and treat the produced fluids.

The recovery of hydrocarbons from a subterranean formation is known in the art as "production." Other substances may also be produced in conjunction with the petroleum, such as water, carbonic gas, sulfuric gas, salts and sand, to mention a few examples.

Depending on the conditions of pressure and temperature the components of the petroleum may be in a gaseous phase or in a liquid phase. Hence, it follows that the fluid that usually flows in a petroleum well may be defined as a multiphase, multicomponent mixture.

As mentioned previously, the wells are bores that traverse diverse rock formations. Typically, a steel pipe, known as a casing is inserted into the bore. Inserted inside of this casing is at least one pipe or tube having a smaller diameter, through which flows the fluids from the reservoir(s). This latter pipe or tube is known as a production pipe or tubing.

The flow of fluids in the interior of a petroleum well, from the reservoir to the ground surface, may be facilitated by the accumulated energy within the reservoir itself, that is, without reliance on an external source of energy to effect such production.

In the absence of an external source of energy for producing the flow of the fluid to the surface, the well is said to be flowing naturally, or that the well is surging or gushing or that the well is producing by natural flow or gushing.

When an external source of energy is employed, for example, a pump in the bottom of the well, the well is said to produce by means of an artificial lifting. Among the diverse methods of artificially lifting, gas lift is distinguished from the other methods. This method is also known as pneumatic lifting or pneumatic pumping.

In a common configuration utilized in this method, natural gas under high pressure is injected into the annular space formed between the casing pipe and the production pipe.

At certain locations along the length of the production pipe, flow control devices, for example, valves known in the art as gas lift valves, are positioned. These flow control devices control the flow of gas that discharges from the annular space to the interior of the production pipe.

There are basically two types of gas lift, these types are known respectively as continuous gas lift and intermittent gas lift.

In the continuous mode the gas is injected continuously at a location of the production pipe, where the gas lift valve is positioned. The expansion of this pressurized gas and the consequential reduction in the apparent density of the multiphase mixture permits a flow of fluids, originating from the reservoir, to be possible in a determined flow rate.

It is typical to effect a control of the injection of gas into these wells by means of a gas flow choke valve (gas choke valve) positioned at the surface and another valve located in the bottom of the well, at some location in the production pipe, this latter valve being the gas lift valve.

In the intermittent modality the gas in injected at some location along the length of the production pipe, namely at a location where a gas lift valve is located and during a certain interval of time. This injection is repeated periodically, that is, a production cycle is involved. Such a cycle includes basically two periods, namely, a period of repose (build-up or feeding period) in which the fluid originating from the reservoir fills the production pipe followed by a period of injection in which pressurized gas is injected through the gas lift valve, and a final period of production/depressurization in which the produced fluid arrives at the collection point and the system is depressurized, after which a new period of feeding is initiated.

The expansion of the pressurized gas impels or drives the liquid, accumulated during the period of repose, which arrives at the surface as a high velocity slug.

The control of the injection of gas into the wells is typically achieved by means of a timer controlling device or intermitter, associated with a gas flow control valve, both of which are positioned at the surface and of a valve positioned in the bottom of the well, at a location in the production pipe. This latter valve is a gas lift valve.

Although there exist variants of the two modalities of gas injection described above, namely continuous and intermittent, these variations do not significantly alter the description provided above of these two methods.

The gas lift valves that are utilized in each of the two modalities for injecting gas, namely continuous and intermittent, may differ significantly, but notwithstanding what type they may be, they are in general housed in components of the production column known in the art as "gas lift mandrels."

A type of gas lift mandrel which is rather common is that known as a "side pocket mandrel."

In this type of mandrel, the gas lift valve is housed in a side pocket, in order to not reduce the area of the straight section of the flow passageway for the fluids originating from the reservoir.

This area is substantially identical to the straight sectional area of the production pipe, thereby making possible a full internal passageway or pathway along the length of the mandrel. A gas lift valve is lodged or seated by way of special tools that are lowered into the well, being retained in a steel cable or wire line. This particular construction is very useful in that it permits the gas lift valve, installed in the interior of a well, to be changed by means of a single operation with wire, without the necessity of withdrawing all of the production piping.

This avoids significant economic loss, in that these operations are very rapid in comparison with the operations of withdrawing the production piping, which requires the use of an intervention unity or rig in wells whose operational costs are much higher than in a operational step with wire.

A great inconvenience encountered in present mandrels of the art relates to the fact that gas lift valves are seated in these mandrels in a way that such an injection of gas occurs in a direction contrary to the direction of flow of fluids originating from the reservoir.

As a consequence, in continuous gas lift, the stream of gas provided by the gas lift valve is slowed down in the initial moment of injection. Thereafter, the gas stream is accelerated in the opposite direction until it reaches the velocity of the main flow.

Moreover, there is no control of the manner in which the gas is injected, that is if it is injected in the form of bubbles (of small or large dimension); in the form of a single stream or in multiple streams; in the form of a stream concentrated in one part or dispersed in all of the flow passage area, in the form of a centralized or tangential stream, etc.

In a similar manner, in the intermittent gas lift, all of the kinetic energy of the gas is also lost. This is a great disadvantage because this energy could otherwise be used to accelerate the gas slug in a more efficient way.

The efficiency of injection may theoretically be augmented even more by directing the introduction of the gas in a manner to diminish the fall back.

In U.S. patent, U.S. Pat. No. 6,148,843, whose description is incorporated herein by reference, a type of gas lift valve is described, which is provided with a orifice valve, equipped with a actuator which makes it possible to vary the dimensions of the orifice, with the object of controlling the flow of injection gas.

The gas lift valve described in U.S. Pat. No. 6,148,843, possesses the particularity of being able to inject gas into the production column as well through its lower end, which is known in the art, as well as through its upper end, which is in fact a novelty.

In reading the description of the gas lift valve of U.S. Pat. No. 6,148,843, the motivation for providing injection capability at both ends of the valve does not appear clear. Notwithstanding, the provision was made in order to compensate for the small available space for the passage of injection gas, the variable orifice valve and the actuator occupy a significant space in the body of the gas lift valve.

In use, this gas lift valve would inject gas in the same direction as that of the flow of the fluids originating from the reservoir since a part of the gas exits the valve through its upper end. However, the valve would also inject gas in the opposite direction, i.e., in the direction opposite to the flow of the fluids originating from the reservoir. In this latter instance, the gas exits the valve from its lower end.

Therefore, a reading of U.S. Pat. No. 6,148,843 does not suggest that the intention of the inventors was to solve the problem of injecting a gas in counter flow, but to provide a gas lift valve with the greatest capacity possible for injecting a gas, which is one of the objects of the invention of U.S. Pat. No. 6,148,843.

In U.S. Pat. No. 3,784,325, whose description is incorporated herein by reference, a continuous gas lift system for petroleum wells is described, whose principal objective is to provide the injection by means of the known Coanda effect.

By means of an apparatus installed in the interior of the well, the flow pattern of the two-phase mixture (constituted by the fluids from the reservoir plus the injection gas) is modified, the pattern passes from a slug or churn flow to a mist flow.

This type of mist pattern would present, by hypothesis, certain advantages related to the reduction in the loss of energy by friction in the production tubing and also that of the flow rate necessary for the injected gas.

The apparatus installed in the interior of the well utilizes components having a venturi geometry and the injection of the gas is made immediately before the nozzles of these venturi and in a tangential direction to the internal surface of these nozzles.

This system presents as a disadvantage the fact that the control of the injection is to be made thorough corresponding slots to the installed device and not through the practical, traditional system of side pocket mandrels and gas lift valves, besides requiring various injection devices along the length of all of the tubing.

Therefore, the control of the discharge of the injection gas in a system is made even more difficult and the replacement of these devices is only possible by means of the use of an intervention utility, e.g., a rig, to withdraw and relocate the production tubing, which considerably increases the cost.

Besides the operational difficulties mentioned above, the description of the invention in U.S. Pat. No. 3,784,325 demonstrates that the injection of gas, when following an adequate pattern, provides improvements in the efficiency of a gas lift.

A possible solution for the first problem, i.e. the injection of gas in counter flow to the flow of fluid from the reservoir, is found in Brazilian Patent Application PI0100140-0, owned by the applicant of the instant application, whose description is incorporated herein by reference.

Basically, the mentioned innovation refers to a continuous gas lift valve, which utilizes a central (or center) body venturi as an element for controlling the flow of the discharge of gas.

One of the embodiments herein described permits the injection of gas in the same direction as that of the flow of the fluid originating from the reservoir, in this instance the central body venturi is positioned above the point of the gas admission from the mandrel, in an inverted position. The gas is, by consequence, injected into the interior of the column of the tubes by the upper part of the gas lift valve and not by the lower edge or nose as normally would occur.

Such a solution, although excellent for valves similar to those described in that application, produces some inconveniences for its application in situations distinct from those described in the application of Brazilian Patent PI0100140-0.

A first inconvenience to be mentioned is that the introduction of passages for the gas in the referenced region of the valve may reduce mechanical resistance and produce ruptures in the body of the valve during the operation of positioning or retracting the valve in the mandrel, in that during the course of these operations, the valve suffers considerable impacting and is subjected to compression or tension forces.

A second inconvenience to be mentioned is related to the fact that it is necessary to effect changes in the geometry or the disposition of internal elements of the valves; changes which, besides not being adequate to the standards of the project already authorized in the art, may not be possible for certain types of valves.

A third inconvenience to be mentioned relates to the fact that the operating companies in the oil fields are typically supplied generally with a considerable stock of gas lift valves for a conventional project and, therefore, it is probably not convenient for them to change a great quantity of available valves for others having an inverted injection. It also should be considered that the cost of this exchange would be very expensive.

As to the solution for the second problem, i.e., the manner in which the gas in injected, one is able to think of a change in the nose of the valve that permits, for example, the pulverization of the gas into a cloud of bubbles, or in another extreme, permits injection in the form of a single stream.

The association of this change in the injection nose with that of the option described in Brazilian Patent Application No. PI0100140-0 that is already cited in the prior paragraph would lead to the apparent solution of two problems (which are: as previously described, that of the injection in counter flow and not being able to follow a certain optimum pattern). Over all, these possibilities are, in practice, very limited because one does not have any certainty as to the exact position of the valve when it is installed in the mandrel. Even if one had this certainty, the exact geometrical configuration would render certain injection arrangements impossible.

In Brazilian Patent Application No. PI004685-0, which is also owned by the applicant of the instant application, whose description is herein incorporated by referenced, a modification in a side pocket mandrel is presented by which the gas originating from the gas lift valve is directed toward the throat of a concentric, eccentric or central body venturi element which is fixed on the internal part of the production tubing and is positioned opposite of the mandrel.

The object of the mentioned invention is to maintain the discharge pressure of the gas lift valve at a value in order to facilitate a critical flow through the valve, which signifies maintaining a constant rate of injection gas. This contributes to a stabilization of the outflow from the oil well which is the principal object of that patent application.

The modification in the geometry of the mandrel is clearly associated with the presence of a venturi element in the production tubing and not to a redirectioning of the gas for the optimization of flow. Besides this the referenced modification may not even be necessary, if the throat of the venturi element inside the production tubing is sufficiently elongated to include all of the area of escape of the gas below the nose of the valve.

Accordingly, a need exists for a new solution for the problem arising in the production in petroleum wells utilizing gas lift, whether continuous or intermittent, in providing an optimized introduction of gas into the flow of fluids, originating from a reservoir, and minimizing the energy inefficiencies.

OBJECTS OF THE INVENTION

The purpose of the present invention is to overcome the drawbacks caused by the injection of gas in the direction opposite to the flow of fluid from the reservoir. More particularly, the present invention proposes a new geometry in the lower part of the mandrel, just beyond the point where the nose of the flow control device (e.g., the valve) is located, from whence the gas exits. The new geometry facilitates a redirectioning of the gas such that it is incorporated into the fluid of the reservoir in the same direction in which the fluid is flowing.

SUMMARY OF THE INVENTION

The present invention relates to a mandrel for a gas lift valve which comprises an elongated body provided with connection means at its ends. The body is provided with a side pocket and a side receptacle, the interior of which is configured to retain a gas lift valve, which valve injects gas into the interior body of the mandrel for the gas lift valve.

The mandrel for the gas lift valve includes additionally a lower body, provided in the lower part of the receptacle for the valve of the mandrel of the side pocket which is configured in a way to seal this lower part of the valve receptacle to thereby form a chamber.

The lower part of the body is provided with at least one injection orifice for injecting gas into the interior of the body of the mandrel for the gas lift valve.

The gas lift valve may also be provided with an upper longitudinal injection opening, whose outlet is located in the upper end of the body of the gas lift valve and through which an additional volume of gas is injected into the interior of the mandrel body for the gas lift valve. This injection occurs in the same direction as the direction of flow of existing fluids in the mandrel for the gas lift valve.

BRIEF DESCRIPTION OF THE DRAWINGS

The invention will be hereinafter described with reference to the drawings that accompany the present specification in which the same numerical references will identify the same elements, wherein.

DETAILED DESCRIPTION OF THE PREFERRED EMBODIMENTS

In the following description are presented diverse details to provide a comprehension of the instant invention. In the meanwhile, it should be understood, by those skilled in the art, that the present invention may be practiced in ways other than those described herein and that various variations or modifications from the described embodiments are possible.

Before beginning a description of the invention, reference will be made to FIG. 1 which illustrates a typical installation of a gas lift, which is well known in the existing art.

Figure 1:
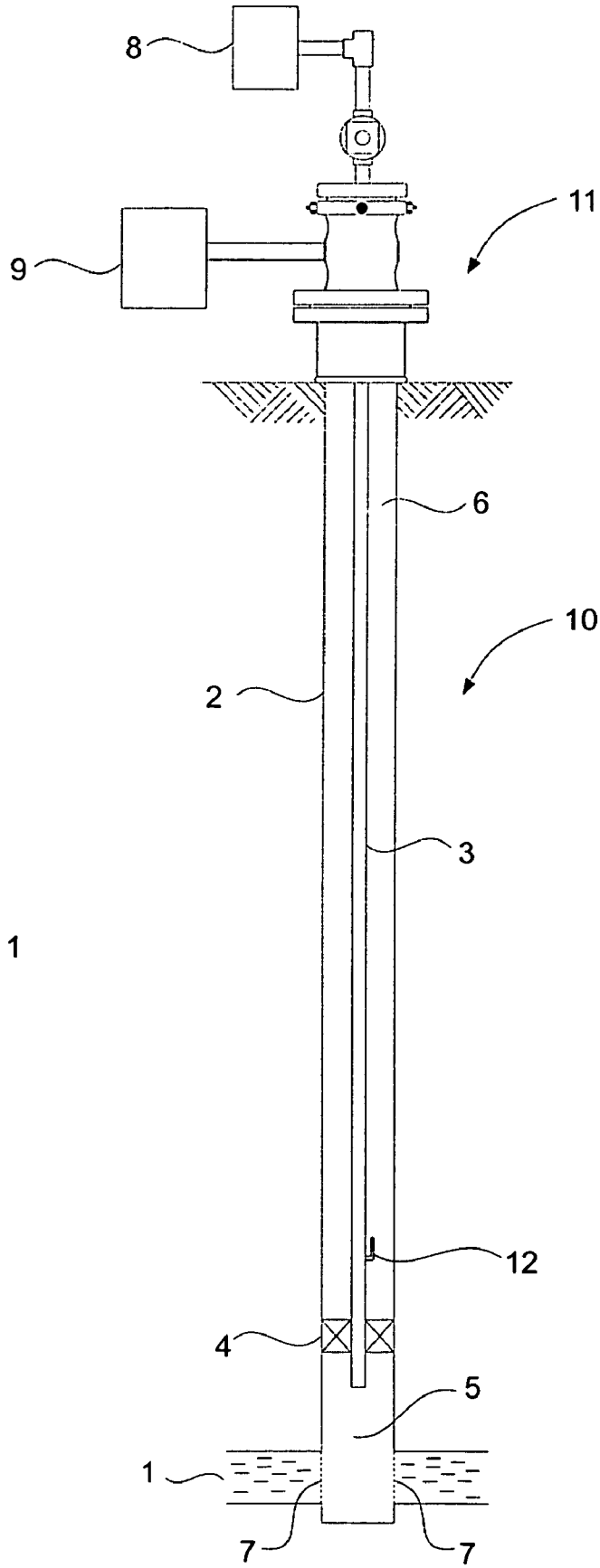
FIG. 1 is a schematic, illustrative view, in partial longitudinal section, that illustrates an oil well equipped to produce by means of gas lift.

FIG. 1 is an illustrative schematic view in partial longitudinal section that shows a schematic representation of a typical installation of a gas lift known in the art. In this Figure is illustrated an oil well (10) equipped to produce by way of a continuous or intermittent gas lift.

The oil well (10) is basically a bore which traverses diverse rock formations and extends from the ground surface until reaching a reservoir (1).

The oil well (10) is provided with a lining in its most external transverse part, this lining constitutes a casing (2) which is also provided with a production tubing (3) which is inserted into the interior of the casing (2).

A packer (4) is installed in the interior of the oil well (10) in a position proximate the reservoir (1), and its function is to create two separate chambers in the interior of the oil well (10): a lower chamber (5) proximate the reservoir (1) and another chamber or annular space (6) formed between the casing (2) and the tubing (3). These two chambers are sealed from one another by means of the packer (4).

On the ground surface is installed an assembly of equipment used to maintain the security and the operation of the well. They are known generically as the well head (11).

The fluids produced from the reservoir (1) enter the petroleum well (10) through the small orifices (7) previously perforated in the casing (2). The produced fluids flow along the length of the tubing (3) until the head of the well (11) then flow thereafter in the direction of the processing installations (8) represented schematically in FIG. 1.

During the continuous gas lift, gas at high pressure, provided from an external source of high pressure gas represented schematically in FIG. 1, is admitted continuously into the annular space (6).

The gas flows through the annular space (6) until passing into the interior of the tubing (3) through a gas lift valve inserted into the mandrel of the gas lift (12) which is installed in the tubing (3).

The injected gas mixes with the fluids originating from the reservoir (1) and this mixture flows continuously toward the ground surface.

It can be said that a continuous gas lift is similar to production by a natural flow, facilitated by the actual energy of the reservoir, wherein a supplementation of gas is injected, below a certain depth, so as to make possible the maintenance of production with a desired flow rate or so as to provide a higher flow rate in relation to that obtained by natural production.

In an intermittent gas lift, after a period of repose during which the reservoir supplies the tubing (3) with a certain volume of fluids, high pressure gas, provided from an external source of gas at high pressure (9) is admitted into the annular space (6).

Thereafter, the gas flows through the annular space until passing through the interior of the tubing (3) through a gas lift valve inserted in the gas lift mandrel (12) installed in the tubing (3).

The high pressure gas pushes the liquid, provided from the reservoir, that was previously accumulated in the tubing (3), upward in the form of a slug. The injection of gas is made during a determined period in order that the slug of liquid flows until reaching the surface of the ground.

Once the injection of gas in interrupted, the system depressurizes. That in turn initiates a new period of repose for the filling of the tubing (3) with fluids provided from the reservoir (1).

The process described above is repeated cyclically.

Another method known in the art for the operation of intermittent gas lift is that of maintaining the annular space (6) in permanent communication with an external source of gas at high pressure (9) instead of maintaining a periodic communication of the annular space (6) with an external source of gas at high pressure (9) as previously described.

The referenced valve is opened periodically by means of a convenient type of gas lift valve. This permits the injection of gas into the interior of the tubing (3).

With the exception of this disclosed detail, the rest of the process remains basically unchanged in relation to that previously described.

Although in FIG. 1 only one mandrel (12) had been represented for the installation of a gas lift valve, oil wells that produce by way of this method are normally provided with various mandrels positioned at various positions along the length of the tubing and these mandrels are equipped with gas lift valves that may include valves of different types.

In the most usual configurations, however, the injection of gas is accomplished through only one single gas lift valve which valve is known as the operating gas lift valve.

Gas lift valves are used to assist in the entrance or the reentrance into production of an oil well. Such valves are called "kick off gas lift valves."

Oil wells equipped for production with gas lift valves may vary in configuration from the embodiment shown in FIG. 1. These variations are only details that seek to provide solutions for specific particular needs, while the basic characteristics of the invention, described above, do not undergo any significant modifications.

These wells are able to be located on shore or off shore. The off shore wells may be provided with equipment at the head of the well which is located in a dry area, for example, on a production platform. Wells of this type are known as dry tree wells. Alternatively, this equipment for the well head may be positioned in wet areas or may be positioned on the sea bed. Wells of this type are known as subsea wells or wet tree wells.

Besides this, in any of the situations mentioned above, a single tubing (3) as pictured in FIG. 1 may be used or alternatively, more than one tubing may be used (for example, a dual completion, triple completion, etc.).

Irrespective of the type of installation mounted in a petroleum well, the well may be equipped with a mandrel of the present invention since the existing installation will not effect in any regard the performance of the referenced mandrel.

Therefore, the scheme represented in FIG. 1 is sufficient for those skilled in the art to be able to understand how the mandrel, which is the subject of the present invention, operates. Furthermore, it will become evident that the referenced mandrel may be used in any tubing, as will be explained later.

Basically, there exist two types of gas lift mandrels, namely the conventional type and the side pocket type.

In the present description the mandrel of the type subject to the present invention will be described as a side pocket mandrel, which is the type of mandrel in most common use. Meanwhile, there is no impediment to the application of the concepts of the present invention to conventional mandrels.

Figure 2:
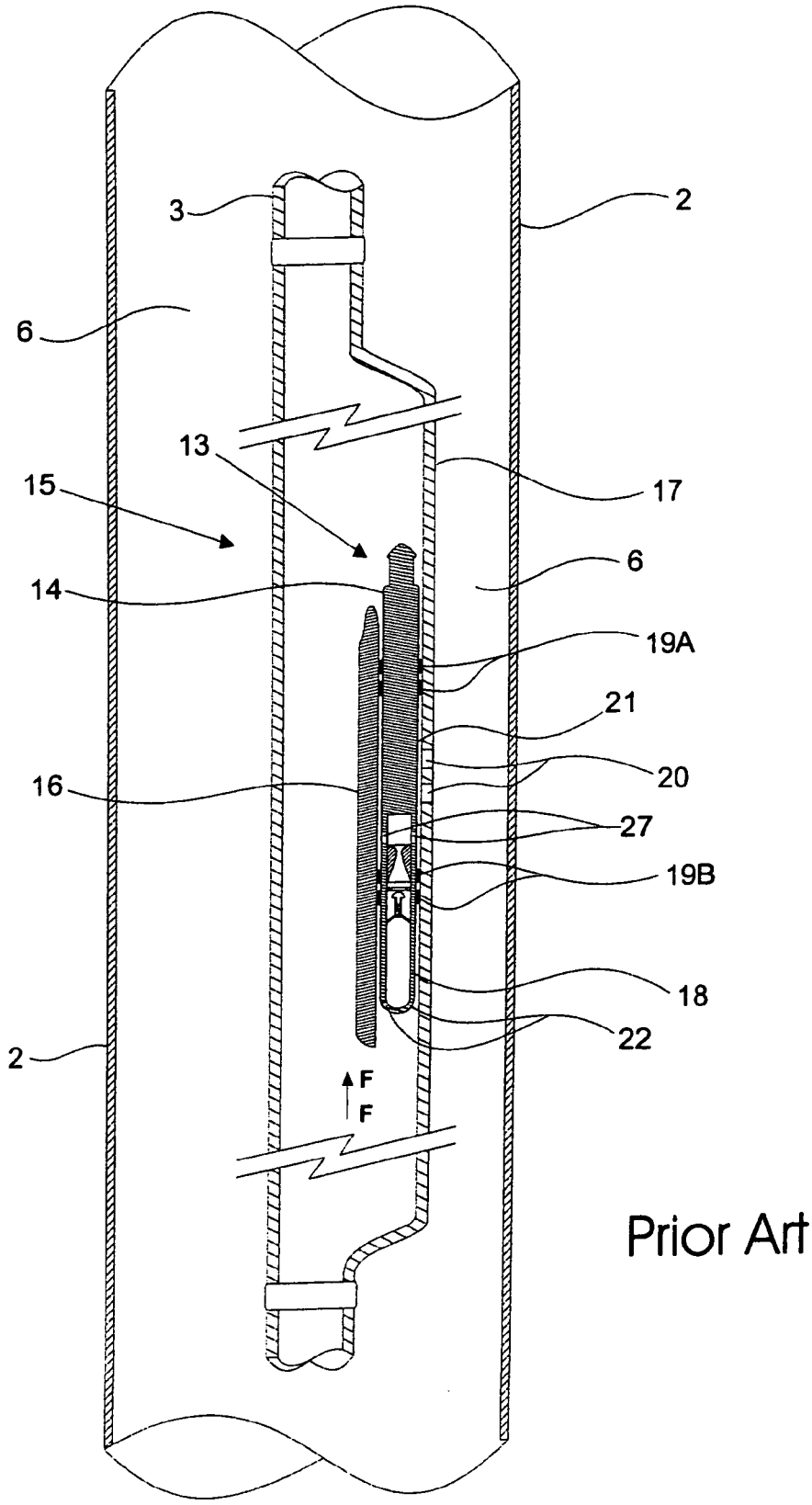
FIG. 2 is an illustrative view in longitudinal section that illustrates a side pocket gas lift mandrel, according to the state of the art, in which is inserted, solely as a example, a gas lift valve of the venturi type.

FIG. 2 illustrates a schematic view in longitudinal section of a gas lift mandrel of a side pocket type. This mandrel comprises an elongated body provided with a side pocket (17) and a valve receptacle (16) in the interior of which is housed a gas lift valve (13). The side pocket gas lift mandrel (15) is provided with threads on its two ends as a means of permitting its connection to the tubing (3).

The side pocket gas lift mandrel (15) is devised in a manner such that the gas lift valve (13) may be replaced when necessary without the necessity of pull out the tubing (3).

This replacement may be accomplished by way of an operation in which special tools are lowered through the interior of the tubing. The special tools are attached to a fine steel cable or to a wire line. This type of operation is well known by those skilled in the art.

The gas lift valve (13) represented in FIG. 2 is of a venturi type, but the valve may also be of any other type known by those versed in the art, such as a orifice or choke valve, bellows valve, nitrogen-charged dome valve, pilot valve, differential valve, to cite only a few examples of those that are well known which will not be described herein.

The gas lift valve (13) is introduced into the valve receptacle (16) of the side pocket (17) where it is maintained under pressure, due to the compression created by the packing (19*a* and 19*b*) which for their part also provide the necessary seals between the body (14) and the gas lift valve (13) and the valve receptacle (16).

The high pressure gas originating from the annular space (6) between the tubing (3) and the casing (2) enters the small annular space (21) formed between the valve receptacle (16), the valve (13) and the side pocket (17) through the openings (20) present in the side pocket (17) of the mandrel (15). This small annular space is maintained sealed by means of gaskets (19*a* and 19*b*).

Thereafter, the gas high pressure enters the valve (13) through the orifices (27) and exits by orifices (22) located in the lower end of the nose (18) and mixes thereafter with the fluids originating from the reservoir (1) as will be seen in the following.

In the process of the continuous gas lift the fluids originating from the reservoir flow in an ascending stream through part of the tubing (3) positioned below the side pocket gas lift mandrel (15) in the direction indicated, by arrow F—F and passes thereafter through the interior of the side pocket gas lift mandrel (15).

Upon passing through the region where the orifices (22) of the nose (18) of the gas lift valve (13) are located, these fluids receive an injection of gas from these orifices (22) which results in the gas mixing with these fluids. This mixture flows through the part of the tubing positioned above the mandrel until reaching the ground surface.

In the operation of the intermittent gas lift, during the period of repose, the fluids originating from the reservoir flow in an ascending stream through the part of the tubing (3) located below the side pocket gas lift mandrel (15), in the direction indicated by arrow F—F. The fluids thereafter pass through the interior of the side pocket gas lift mandrel (15).

The flow is much slower than that which occurs in the continuous modality of the gas lift and the quantity of liquid (oil with gas in solution, augmented or not with water) accumulates above the mandrel of the gas lift (15) at the same time as the free gas bubbles through the liquid and is thereafter collected on the surface of the ground.

Once the repose phase is finished, the period of which is calculated as a function of the productivity of the petroleum reservoir and the maximum pressure of the injection gas, a phase of injecting gas through the gas lift valve is initiated. The gas lift valve is normally of a type which is different from that illustrated in FIG. 2.

After passing through the orifices (22) of the nose (18) of the gas lift valve (13) this gas expands and causes the column of liquid, previously accumulated above the orifices (22), to rise as a liquid slug, through the part of the tubing above the mandrel until it reaches the surface of the ground.

This process of displacing the liquid slug is not perfect and a part of the liquid forming the slug does not arrive at the ground surface, but instead, is deposited in the bottom of the tubing. This creates a dead volume that reduces the efficiency of the process.

The dead volume, produced by the slippage between the gaseous phase and the liquid phase during the displacement of the slug is known by the English term "fallback" and is a function of various factors. The inventor of the present invention believes that among these factors, one that most influences this slippage between the phases is the manner in which the gas is injected below the body of the slug of liquid.

The present invention refers to a new configuration of side pocket mandrels for gas lift valves that solves the problem of injecting gas in a direction opposite to the flow direction of the production fluids originating from the reservoir and in a chaotic manner, i.e., with no control aiming at the improvement of the gas lift efficiency.

Figure 3:
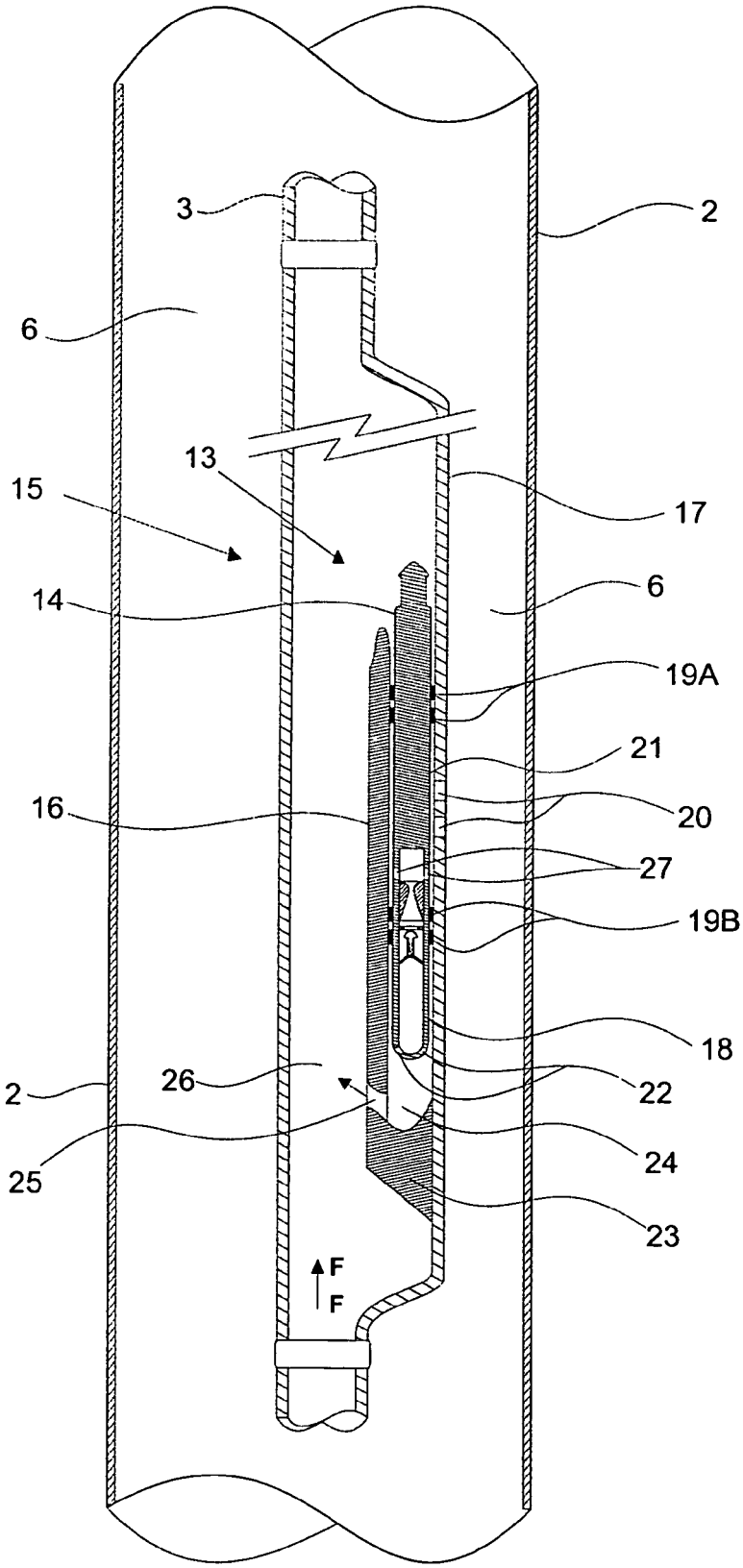
FIG. 3 is an illustrative view in longitudinal section that illustrates a first embodiment of a side pocket gas lift mandrel, according to the present invention, configured for the redirectioning into a single flow of injected gas, with a gas lift valve of the venturi type inserted into the mandrel.

FIG. 3 shows in illustrative form a first embodiment of a proposed modification in the mandrel of a gas lift valve of the instant invention.

In this embodiment the valve receptacle (16) of the side pocket mandrel (15) is provided in its lower part with a lower body (23), which is adequately configured to seal the lower part of the valve receptacle, which normally is open.

This creates a chamber (24). The gas supplied through the orifices (22) of the nose (18) of the gas lift valve is discharged into the interior of this chamber.

An injection orifice (25) interconnects the chamber (24) to the region of the mandrel where the fluids flow as indicated in FIG. 3 by the number 26. A single stream of gas exits through this injection orifice (25) in the direction of a central portion of the region of flow (26) consistent with that indicated by the arrow shown in FIG. 3 at the exit of the injection orifice (25).

With this, from the point in which the single jet of gas emerges from the opening (25), an effective mixing of the injected gas with the fluids originating from the reservoir occurs.

The referenced injection orifice (25) should be configured with a geometric shape and a surface finish sufficient to avoid localized losses of energy that may reduce the pressure of the gas stream.

The injection of gas may be directed to a point in the interior of the region of the flow (26) or alternatively the injection may occur in a manner tangential to the internal surface of the region on the flow (26) so that benefits are achieved from secondary effects, such as the Coanda affect described previously.

Figure 4:
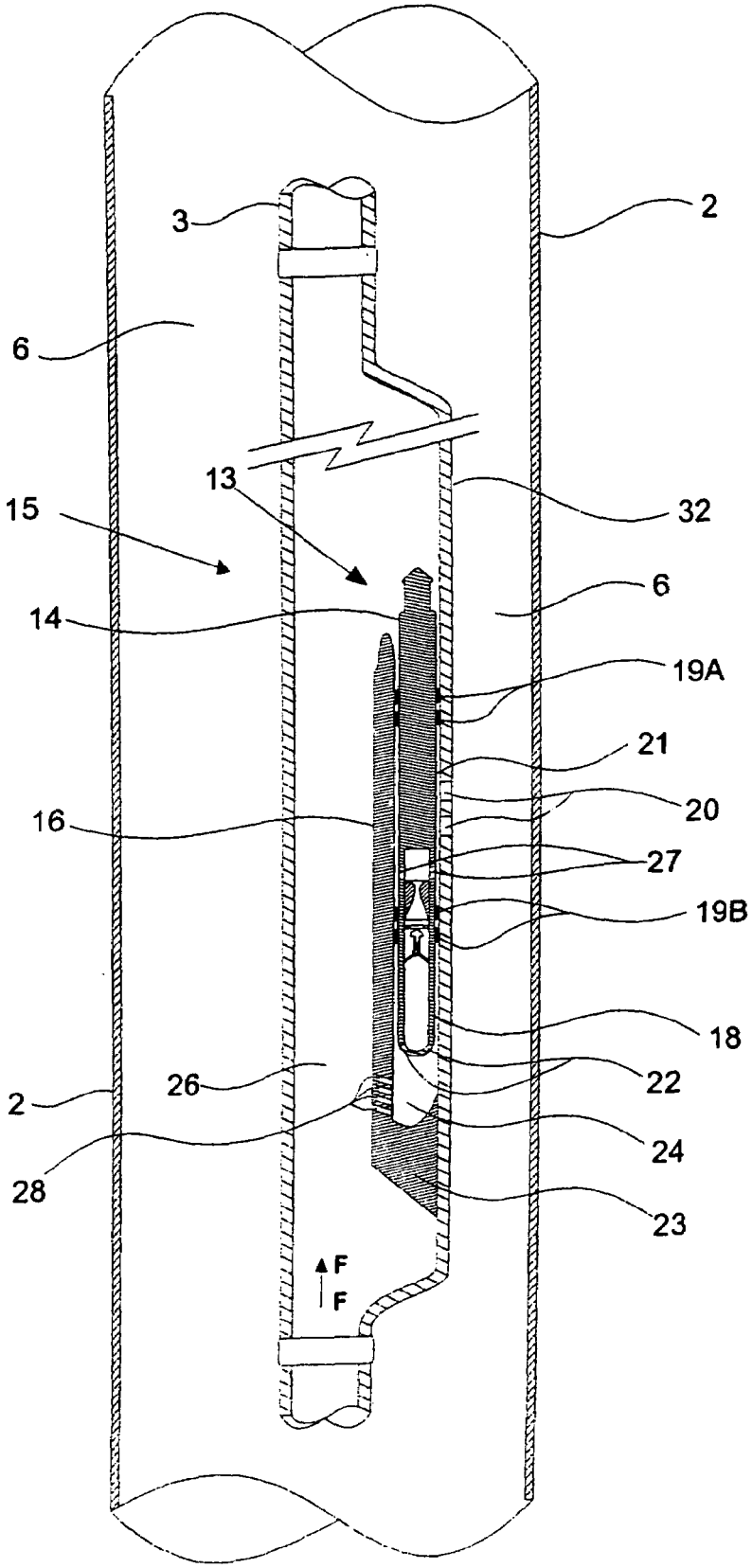
FIG. 4 is an illustrative view in longitudinal section that illustrates a second embodiment of a side pocket gas lift mandrel, according to the present invention, in which the gas is injected in multiple streams with a gas lift valve of a venturi type inserted into the mandrel.

FIG. 4 represents an alternative embodiment of the gas lift valve mandrel of the instant invention.

The difference in between this embodiment and the embodiment presented in FIG. 3 is in the fact of there being provided a plurality of injection orifices (28) to interconnect the chamber (24) to the flow region (26).

With these, a division occurs in the stream of the gas, flowing from the chamber (24) to the flow region (26) and the gas that exits these injection orifices (28) then mixes with the fluids originating from the reservoir.

In the same form as in the previous embodiment the openings should be provided for with geometric shapes and surface finishes adequate to avoid localized losses of energy that reduce the pressure of the gas stream.

The injection orifices (28) may be provided in large or small quantities. They may be of different shapes, they may all be directed to the same point or part of them may be directed to different points within the interior region of the flow (26).

The injection orifices (28) in their totality or at least a part of them may be directed to produce an injection which is tangential to the interior surface of the production tubing to achieve the benefits of secondary effects such as the Coanda effect described above.

The instant invention provides the possibility of fabricating a mandrel of the type made subject to the instant invention as a entirely new apparatus or alternatively one can adapt existing mandrels to receive a lower body (23) and the respective injection orifices (25) or (28) as desired.

Alternatively, one may conceive of an approach in which the lower body (23) for use in the redirectioning of the gas would be inserted in a mandrel through an operation by wire line in a manner similar to that utilized for gas lift valves, however, this would likely present limitations as to the possibility of injection arrangements due to the difficulty of correctly positioning the openings.

This solution of inserting the lower body (23) by way of an operation by wire line would be similar to that which would result in making an adaptation directly to the nose of the valve, as previously described in the description of the related art.

The advantage, presented here through the present invention, would be that it would not be necessary to alter existing gas lift valves in order for them to be used in the manner herein described, in that such alterations may complicate or at the same time, render impossible the operation of seating or retracting the valve by wire line, with the mandrels as actually used.

Figure 5:
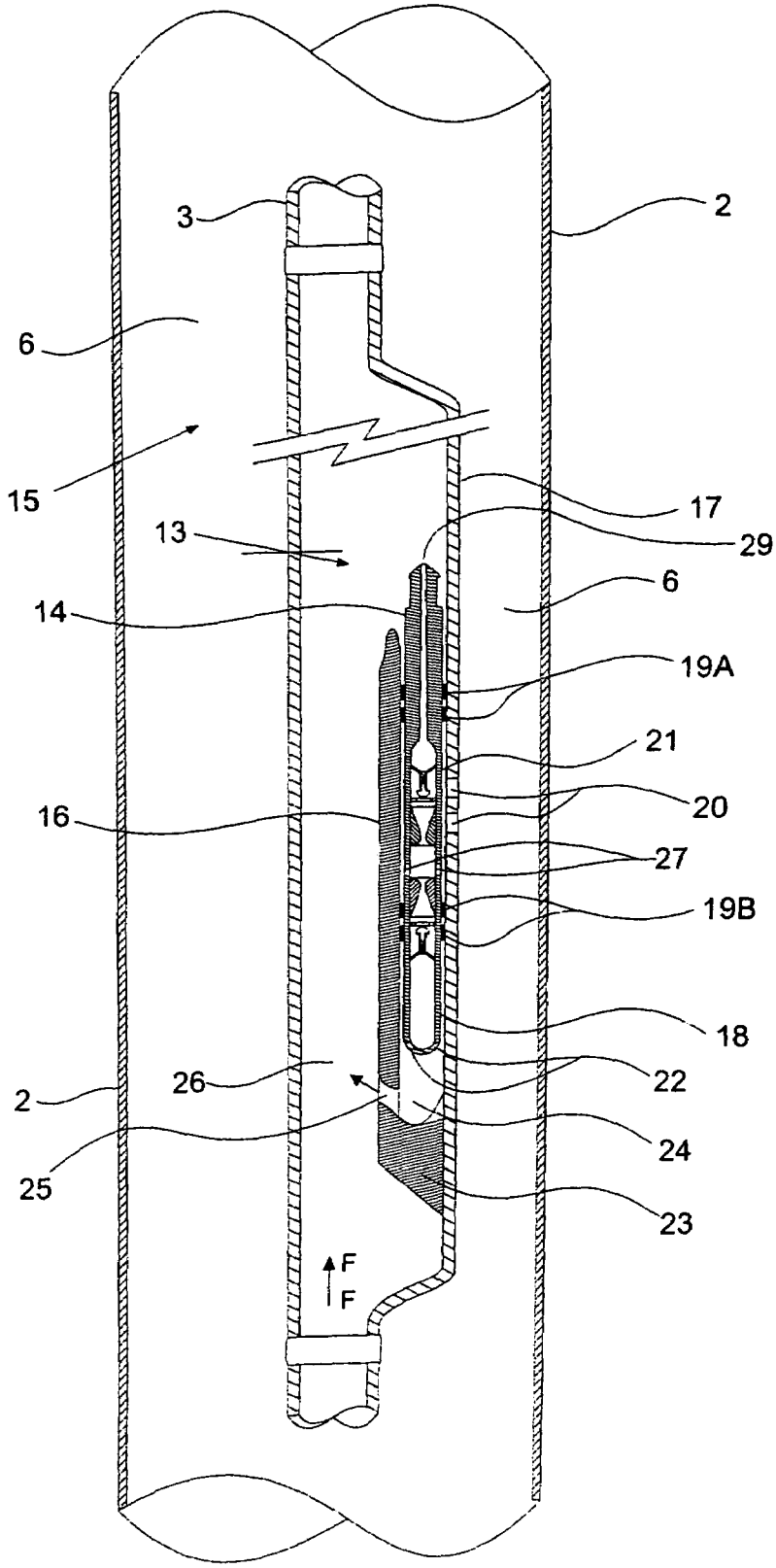
FIG. 5 is an illustrative view in longitudinal section that illustrates a situation in which the employed gas lift valve is provided with means for injecting gas through its upper and lower ends.

Another possibility to be considered, as shown in FIG. 5, is that of making some alterations to the gas lift valve (13) of a type such that the valve would have an upper longitudinal opening for injection (29) located in an upper end of the body (14) of the gas lift valve (13) through which an additional volume of gas may be injected into the interior of the column of production. This injection also would occur in the direction of the stream of the fluids originating from the reservoir.

It should be mentioned here that the embodiment shown in FIG. 5 may employ any type of gas lift valve that would be capable of providing injection gas through its two ends. This embodiment should not be viewed as being limited to the model of valve illustrated in FIG. 5.

Those skilled in the art will immediately perceive that innumerable other variations of geometry are also possible for the mandrel made subject of the instant invention.

Although the invention has been described with relation to its preferred embodiments, the description above should not be taken as a limitation of the present invention which is alone limited by the scope of the claims that follow.

What is claimed is:

1. A mandrel for a gas lift valve (15) which comprises an elongated body, provided with means of connection at its ends, said body provided with a lateral side pocket, (17) and a side receptacle (16) the interior of which is able to house a gas lift valve (13) which injects gas into the interior of the body of the mandrel for the gas lift valve (15) by way of orifices (22) positioned in a nose (18), the mandrel for the gas lift valve (15) characterized by, additionally comprising:

a lower body (23) provided in the lower part of the receptacle for the valve (16) of the side pocket mandrel (15), in that said lower body (23) is configured in a manner to seal the lower part of the valve receptacle (16) to form a chamber (24);

in that the lower body (23) is provided with at least one injection orifice to inject gas upwards into the interior (26) of the body of the mandrel for gas lift valve (15).

2. Mandrel according to claim 1, wherein said at least one injection orifice comprises a single injection orifice (25).

3. Mandrel according to claim 1, wherein said at least one injection orifice comprises a single injection orifice (25), which directs the flow of gas provided by the chamber (24) in a direction tangential to the surface of the interior (26) of the body of the mandrel for the gas lift valve.

4. Mandrel according to claim 1, wherein said at least one injection orifice comprises a plurality of injection orifices (28).

5. Mandrel according to claim 1, wherein said at least one injection orifice comprises a plurality of injection orifices (28), which direct the flow of gas provided by the chamber (24) in a direction tangential to the surface of the interior (26) of the body of the mandrel of said gas lift valve (15).

6. Mandrel according to claim 1, wherein said at least one injection orifice comprises a plurality of injection orifices (28), so that part of these injection orifices (28) direct the flow of gas provided by the chamber (24) in a direction tangential to the surface of the interior (26) of the body of the mandrel of said gas lift valve (15) and the remaining injection orifices (28) direct the flow of gas provided by the chamber (24) to the central region of interior (26) of the mandrel of said gas lift valve (15).

7. Mandrel according to any one of claims 4 to 6, wherein the injection orifices of the said plurality of openings (28) are able to present one of at least two different geometrical shapes.

8. A gas lift mandrel (15), comprising:

a side pocket (17) in a tubing (3);

a valve receptacle (16) positioned in the side pocket (17), comprising:

a valve receptacle wall spaced from an interior surface of the side pocket (17);

a lower body (23) in communication with the valve receptacle wall and defining a chamber (24) between an interior surface of the lower body (23) and the side pocket (17); and at least one orifice (28) through the lower body (23) and configured to direct the flow of a gas from the chamber (24) to an interior (26) of the gas lift mandrel (15) in a direction tangential to the surface of the interior (26) of the gas lift mandrel (15); and a gas lift valve (13) positioned between the side pocket (17) and the valve receptacle (16), wherein the gas lift valve (13) is configured to deliver gas to the chamber (24).

9. A gas lift mandrel comprising:

a tubing defining a side pocket therein, said tubing defining a flow path there through;

a valve receptacle structure for retaining a gas valve, said valve receptacle being positioned within said side pocket and within said flow path defined within said tubing, said valve receptacle structure comprising:

a valve receptacle dimensioned to retain a gas valve; and a lower body, positioned elevationally below said valve receptacle and defining a chamber which communicates with said valve receptacle;

wherein said lower body defines a passageway which is upwardly inclined relative to the horizon, said passageway being disposed to communicate said chamber with said tubing flow path through an orifice defined in said lower body.

10. The gas lift mandrel of claim 9 wherein said orifice is positioned within said flow path of said tubing and spacedly from a sidewall of said tubing.

11. The gas lift mandrel of claim 9 wherein said orifice is positioned elevationally below said valve receptacle.

12. The gas lift mandrel of claim 9 wherein said lower body defines a plurality of upwardly inclined passageways disposed to communicate with said chamber, each of said upwardly inclined passageways having a respective orifice defined in said lower body.

13. The gas lift mandrel of claim 12 wherein each of said orifices is positioned elevationally below said valve receptacle.

14. The gas lift mandrel of claim 9 further comprising a gas lift valve positioned within said valve receptacle.

15. The gas lift mandrel of claim 14 wherein said gas lift valve has an upper injection opening at an upper end of said gas lift valve and a second injection opening disposed in a lower end of said gas lift valve which communicates with said chamber; wherein said upper injection opening facilitates an injection of fluid directly into an interior of said tubing in a direction parallel to said flow path of said tubing.

16. The gas lift mandrel of claim 9 wherein a lower surface of said lower body is upwardly inclined.

* * * * *